US007017677B2

(12) United States Patent
Keshavan et al.

(10) Patent No.: US 7,017,677 B2
(45) Date of Patent: Mar. 28, 2006

(54) COARSE CARBIDE SUBSTRATE CUTTING ELEMENTS AND METHOD OF FORMING THE SAME

(75) Inventors: Madapusi K. Keshavan, The Woodlands, TX (US); Anthony Griffo, The Woodlands, TX (US); David Truax, Houston, TX (US); Dah-Ben Liang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/437,750

(22) Filed: May 14, 2003

(65) Prior Publication Data

US 2004/0016557 A1 Jan. 29, 2004

Related U.S. Application Data

(60) Provisional application No. 60/398,374, filed on Jul. 24, 2002.

(51) Int. Cl.
*E21B 10/08* (2006.01)
*E21B 10/46* (2006.01)

(52) U.S. Cl. ..... 172/701.3; 172/681; 175/374; 175/426; 175/434; 75/236

(58) Field of Classification Search ..... 172/681, 172/747, 701.2, 701.3; 175/374, 425, 426, 175/427, 428, 430, 433, 434; 75/236, 240
See application file for complete search history.

(56) References Cited

U.S. PATENT DOCUMENTS

| | | | |
|---|---|---|---|
| 4,017,480 | A | 4/1977 | Baum |
| 4,142,888 | A | 3/1979 | Rozmus |
| 4,341,557 | A | 7/1982 | Lizenby |
| 4,368,788 | A | 1/1983 | Drake |
| 4,372,404 | A | 2/1983 | Drake |
| 4,398,952 | A | 8/1983 | Drake |
| 4,428,906 | A | 1/1984 | Rozmus |
| 4,545,441 | A | 10/1985 | Williamson |
| 4,608,318 | A | 8/1986 | Makrides et al. |
| 4,656,002 | A | 4/1987 | Lizenby et al. |
| 4,673,549 | A | 6/1987 | Ecer |
| 4,723,996 | A | 2/1988 | Brunet et al. |
| 4,744,943 | A | 5/1988 | Timm |
| 4,859,543 | A | 8/1989 | Greenfield et al. |
| 4,861,350 | A | 8/1989 | Phaal et al. |
| 4,945,073 | A | 7/1990 | Dubensky et al. |

(Continued)

FOREIGN PATENT DOCUMENTS

| | | | |
|---|---|---|---|
| EP | 0052 922 | B1 | 11/1984 |
| EP | 0272913 | A3 | 6/1988 |
| EP | 0 288 775 | A1 | 11/1988 |
| EP | 0480895 | A3 | 4/1992 |
| EP | 0819 777 | B1 | 10/2001 |
| GB | 1 574 615 | | 9/1980 |
| GB | 2 239 028 | A | 6/1991 |
| GB | 2 330 850 | A | 12/1997 |
| GB | 2333541 | A | 7/1999 |
| WO | WO 81/03295 | | 11/1981 |
| WO | WO 95/16530 | | 6/1995 |
| WO | WO 96/20058 | | 7/1996 |

*Primary Examiner*—Robert E. Pezzuto
*Assistant Examiner*—Alexandra Pechhold
(74) *Attorney, Agent, or Firm*—Christie, Parker & Hale, LLP

(57) ABSTRACT

Cutting elements having coarse grain substrates and ultra hard material layers are provided. The substrates are formed from coarse grain size particles of tungsten carbide. A method of forming such cutting elements and a drag bit incorporating such cutting elements are also provided.

31 Claims, 10 Drawing Sheets

U.S. PATENT DOCUMENTS 5,089,182 A 2/1992 Findeisen et al.
5,120,327 A 6/1992 Dennis
5,290,507 A 3/1994 Runkle
5,358,545 A 10/1994 Nagro
5,423,899 A 6/1995 Krall et al.
5,441,693 A 8/1995 Ederyd et al.
5,484,468 A 1/1996 Östlund et al.
5,563,107 A * 10/1996 Dubensky et al. ..... 501/87
5,593,474 A 1/1997 Keshavan et al.
5,653,299 A 8/1997 Sreshta et al.
5,880,382 A 3/1999 Fang et al.
5,891,522 A 4/1999 Olson
6,063,502 A 5/2000 Sue et al.
6,126,709 A 10/2000 Akerman et al.
6,197,084 B1 3/2001 Liang
6,244,364 B1 6/2001 Cariveau et al.
6,365,230 B1 4/2002 Baik et al.
6,655,478 B1 * 12/2003 Liang et al. ..... 175/374
2002/0029909 A1 * 3/2002 Griffo et al. ..... 175/374
2002/0124688 A1 * 9/2002 Liang ..... 75/240
2003/0049434 A1 * 3/2003 Liu et al. ..... 428/325
2003/0111272 A1 * 6/2003 Liang et al. ..... 175/426
2003/0226693 A1 * 12/2003 Liang et al. ..... 175/374

* cited by examiner

614 Grade

812 Grade

916 Grade

WC Grain Grades

COARSE CARBIDE SUBSTRATE CUTTING ELEMENTS AND METHOD OF FORMING THE SAME

CROSS-REFERENCE TO RELATED APPLICATION

This application claims priority based on U.S. provisional application No. 60/398,374, filed Jul. 24, 2002, which is incorporated herein by reference.

FIELD OF THE INVENTION

The present invention is generally related to a method for forming coarse carbide substrates for cutting elements and more particularly to a high pressure and high temperature synthesis method of forming polycrystalline diamond ("PCD") and polycrystalline cubic boron nitride ("PCBN") cutting elements, to such cutting elements and to a drag bit incorporating the same.

BACKGROUND OF THE INVENTION

Cutting elements such as shear cutters for drag bit type of rock bits, for example, typically have a body (or substrate), which has a contact face. An ultra hard layer is bonded to the contact face of the body by a sintering process to form a cutting layer (sometimes referred to as a "cutting table"). The body is generally made from tungsten carbide-cobalt (sometimes referred to simply as "tungsten carbide" "or carbide"), while the ultra hard material layer is a polycrystalline ultra hard material, such as polycrystalline diamond ("PCD") or polycrystalline cubic boron nitride ("PCBN").

Common problems that plague cutting elements having an ultra hard material layer, such as PCD or PCBN bonded on a carbide substrate are chipping, spalling, partial fracturing, cracking or exfoliating of the cutting table. These problems result in the early failure of the ultra hard layer and thus, in a shorter operating life for the cutting element. Typically, these problems may be the result of peak (high magnitude) stresses generated on the ultra hard layer at the region in which the layer makes contact with an external body, such as when the cutting layer makes contact with the earthen formation during drilling.

Generally, shear cutter type cutting elements are mounted onto a drag bit body at a negative rake angle. Consequently, the region of the cutting element that makes contact with the earthen formation includes a portion of the ultra hard material layer upper surface circumferential edge. This portion of the layer is subjected to the highest impact loads. Accordingly, much of the research into shear cutters has focused on making a more durable ultra hard material layer, or making a better interface between the ultra hard material layer and the substrate. However, it is equally important that the substrate of the cutting element be durable. For example, cracks initiated in the ultra hard material layer due to contact loads can propagate into the substrate. Accordingly, the toughness of the substrate plays a significant role on the breakage resistance of cutting elements.

One common substrate material is cemented tungsten carbide. Cemented tungsten carbide generally refers to tungsten carbide ("WC") particles dispersed in a binder metal matrix, such as iron, nickel, or cobalt. Cemented tungstem carbide having tungsten carbide particles dispensed in cobalt is often referred to as a "WC/Co" system. Tungsten carbide in a cobalt matrix is the most common form of cemented tungsten carbide, which is further classified by grades based on the grain size of WC and the cobalt content.

Tungsten carbide grades are selected primarily based on two factors that influence the lifetime of a tungsten carbide substrate: wear resistance and toughness. Existing substrates for shear cutters are generally formed of cemented tungsten carbide particles (with grain sizes in the range of about 1 to 3 μm as measured by ASTM E-112 method) and cobalt (with the cobalt content in the range of about 9% to 16% by weight), and have a hardness in the range of about 86 Ra to 89 Ra.

For a WC/Co system, it is typically observed that the wear resistance (i.e., hardness) increases as the grain size of tungsten carbide or the cobalt content decreases. On the other hand, the fracture toughness increases with larger grains of tungsten carbide and greater percentages of cobalt. Thus, fracture toughness and wear resistance tend to be inversely related, i.e., as the grain size or the cobalt content is decreased, wear resistance of a specimen is improved, and its fracture toughness decreases, and vice versa. Due to this inverse relationship between fracture toughness and wear resistance (i.e., hardness), the grain size of tungsten carbide and the cobalt content are selected to obtain a desired wear resistance and toughness.

Despite these counter-balancing concerns, conventional cutting element designs have generally focussed only on the toughness of the chosen material. For example, generally one skilled in the art would select a carbide grade with high toughness, because in earth boring applications wear of the carbide is not a major issue.

In addition, the thermal properties of a tungsten carbide substrate, such as thermal conductivity, are generally not considered. As a result, thermal fatigue and heat checking in tungsten carbide substrates are issues that have not been adequately resolved. Consequently, substrates made of conventional tungsten carbide grades frequently fail due to heat checking and thermal fatigue when subjected to high temperature and high loads.

Accordingly, there exists a need for improving the toughness of carbide substrate without significantly reducing the wear resistance and thermal conductivity.

SUMMARY OF THE INVENTION

The present invention is directed to cutting elements such as a shear cutters, to methods for making such cutting elements and to drag bits incorporating such cutting elements. The substrates of the cutting elements are formed from coarse grain substrate material, such as a cemented carbide having coarse tungsten carbide particles cemented by a cobalt binder.

In one exemplary embodiment a cutting element is provided having a substrate having an end surface, wherein the substrate is formed by the consolidation of a composition comprising tungsten carbide and a binder material. The substrate after consolidation has a median particle size of at least 6 μm, and/or a Rockwell A (Ra) hardness not greater than 87, and/or an impurity content of the tungsten carbide being not greater than about 0.1% by weight. An ultra hard material layer is formed over the end surface of the substrate. This exemplary embodiment cutting element may also include at least one intermediate layer between the substrate and the ultra hard material layer.

In another exemplary, the cutting element substrate has a median particle size of at least about 9 μm. In yet another exemplary embodiment, the substrate has a fracture toughness after consolidation of at least about 18 ksi(in)$^{0.5}$. In a further exemplary embodiment, the substrate has a hardness after consolidation in the range from about 83 to about 85 Rockwell A.

In yet a further exemplary embodiment, after consolidation the substrate has a fracture toughness of at least about 18 ksi(in)$^{0.5}$ and a hardness in the range from about 83 to about 87 Rockwell A. In another exemplary embodiment the ultra hard material comprises ultra hard material particles, wherein the median particle size of the ultra hard particles is approximately the same as the median particle size of the substrate.

In one exemplary embodiment, the substrate has at least a 6% concentration of particles having a grain size of at least 7 μm or more. In another exemplary embodiment, the substrate has cobalt and the impurity content of the tungsten carbide is controlled to provide a thermal conductivity after consolidation not less than a value $K_{min}$ as determined by the following equation:

$$K_{min}=0.38-0.00426X,$$ where $X$ in the substrate cobalt content in weight %.

In another exemplary embodiment, the substrate has cobalt and the substrate composition has a minimal Rockwell A scale hardness $H_{min}$ after consolidation defined by the equation:

$$H_{min}=91.1-0.63X,$$ where $X$ is the substrate cobalt content in weight %.

In yet another exemplary embodiment, the substrate has cobalt, and the impurity content of the tungsten carbide is controlled to provide a thermal conductivity not less than a value $K_{min}$ as determined by the following equation:

$$K_{min}=0.00102X^2-0.03076X+0.5464,$$

where X is the substrate cobalt content in weight %, and $K_{min}$ is in the units of cal/cm·s·K.

Another exemplary embodiment cutting element of the present invention has a substrate having tungsten carbide particles and a cobalt binder disposed around the particles. The grain size of the tungsten carbide particles and a content of the cobalt binder are selected to provide the substrate with a fracture toughness of at least about 18 ksi (in)$^{0.5}$ and a wear number of at least about 2. A polycrystalline ultra hard material layer is disposed over the substrate. In another the substrate has a hardness in a range of about 85 to 87 Rockwell A.

A yet further exemplary embodiment cutting element has a substrate having tungsten carbide particles and a cobalt binder disposed around the particles. The grain size of the tungsten carbide particles and a content of the cobalt binder are selected to provide the substrate with a fracture toughness of at least about 20 ksi (in)$^{0.5}$ and a wear number of at least about 1.5. An ultra hard material layer is disposed over the substrate. In another exemplary embodiment, the substrate has a hardness in a range of about 83 to 85 Rockwell A.

In another exemplary embodiment, a method is provided for manufacturing a cutting element by providing a substrate having an endsurface. The substrate is formed from a composition including tungsten carbide having a median particle size of at least 6 μm and/or an impurity content of not greater than 0.1% by weight, and a binder material. The substrate is formed by heating the composition causes the binder to infiltrate and cement the tungsten carbide. An ultra hard material layer is placed over the substrate end surface and the resulting assembly of substrate and ultra hard material layer is processed at a sufficient temperature and pressure for forming polycrystalline ultra hard material and metallurgicaly joining of the substrate and polycrystalline ultra hard material. In a further exemplary embodiment method, the tungsten carbide is provided in powder form and is cemented with a binder during the act of heating for forming the polycrystalline ultra hard material. In an alternate exemplary embodiment, the tungsten carbide powder and binder may be heated to at least partly cement the tungsten carbide powder prior to heating for forming the polycrystalline ultra hard material. Other conventional methods may be used for forming the cutting elements of the present invention.

In another exemplary embodiment method, the tungsten carbide is provided in powder form having a 6% concentration of particles having a grain size of at least 7 μm. In yet a further exemplary embodiment, the binder includes cobalt, and the impurity content of the tungsten carbide powder is controlled to provide a thermal conductivity not less than a value $K_{min}$ as determined by the following equation:

$$K_{min}=0.38-0.00426X,$$ where $X$ in the substrate cobalt content in weight %.

In a further exemplary embodiment method the binder comprises cobalt, and the impurity content of the tungsten carbide powder is controlled to provide a thermal conductivity not less than a value $K_{min}$ as determined by the following equation:

$$K_{min}=0.00102X^2-0.03076X+0.5464,$$

where X is cobalt content in weight %, and $K_{min}$ is in the units of cal/cm·s·K.

In yet another exemplary embodiment method, the ultra hard material has a median ultra hard material particle size that is approximately the same as the median particle size of the tungsten carbide powder.

In another exemplary embodiment a drag bit is provided incorporating any of the aforementioned exemplary embodiment cutting elements.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
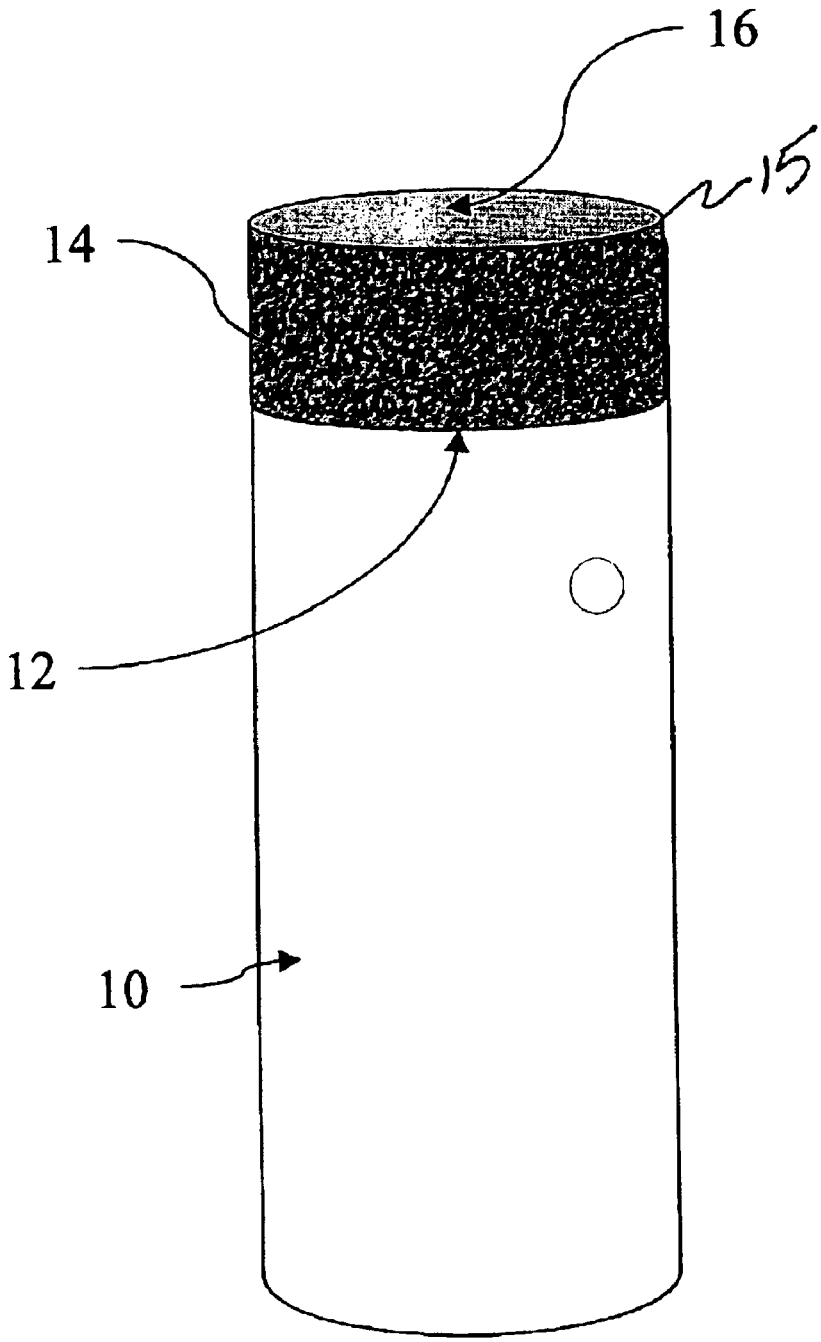
FIG. 1 is a perspective view of a shear cutter.

This invention is related to cutting elements, such as shear cutters having ultra hard material cutting tables on a substrate comprised of coarse grain tungsten carbide and cobalt and to a method of making the same. Moreover, the present invention relates to a bit such as a drag bit incorporating such cutting elements. The present invention is described in relation to a cylindrical shear cutter type of cutting element. An exemplary shear cutter as shown in FIG. 1, has a cylindrical tungsten carbide body 10 which has an interface or end surface 12. An ultra hard material layer 14 is bonded onto the interface 12 and forms the cutting layer (also referred to as a cutting face or table) 16 of the cutting element. Examples of ultra hard materials capable of forming the ultra hard material layer include polycrystalline diamond (PCD) and a polycrystalline cubic boron nitride (PCBN). In an alternative embodiment at least one intermediate or transition layer (not shown) is placed between the substrate and the ultra hard cutting layer. In such an embodiment it is preferred that the intermediate layer have properties between the properties of polycrystalline ultra hard material layer and the coarse carbide substrate.

Exemplary embodiments of the invention meet the need for an improved impact resistant cutting element for use in drag bits by providing a high purity coarse grain substrate composition including tungsten carbide in a cobalt binder matrix. Specifically, the substrate composition of the exemplary cutting elements has a grain grade wherein the median particle grain size exceeds 6 μm and the tungsten carbide impurity level is kept at about 0.1% or less by weight. Such a composition not only has good thermal fatigue and shock resistance, but also meets the desired toughness and wear resistance for earth cutting applications. Specifically, using substrates according to the current invention provide cutting elements having improved physical properties, including at least one of a fracture toughness of at least about 18 ksi(in)$^{0.5}$ and preferably of at least about 20 ksi(in)$^{0.5}$, a wear number of at least about 1.5 krev/cc, and preferably of at least about 2 krev/cc, a Palmqvist toughness of at least about 600 kg/mm, a Rockwell A ("Ra") hardness of between about 83 to 87 and more preferably of about 83 to 85, and a normalized thermal fatigue resistance of at least about 1.4, and preferably of at least about 1.5. Accordingly, substrates according to the present invention may also be defined by the above-listed physical properties, which are representative of the improved mechanical and thermal properties of the substrates.

Figure 2:
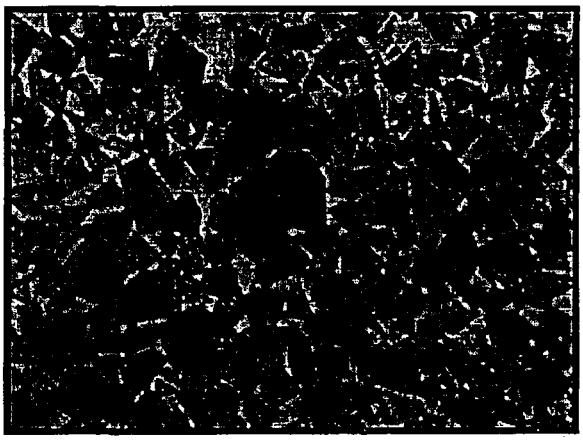
FIG. 2 is a micrograph of a conventional tungsten carbide substrate.
Figure 3:
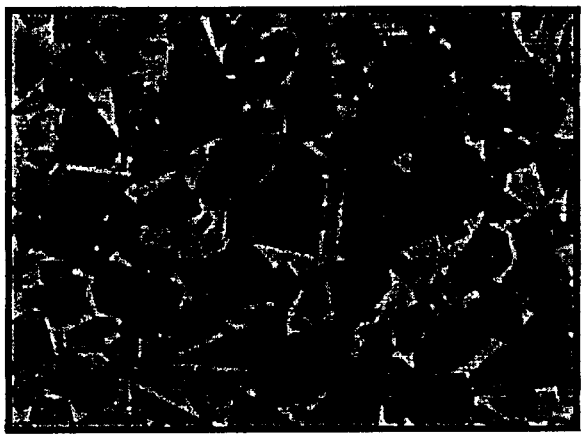
FIG. 3 is a micrograph of an exemplary embodiment coarse grade tungsten carbide substrate according to the present invention.
Figure 4:
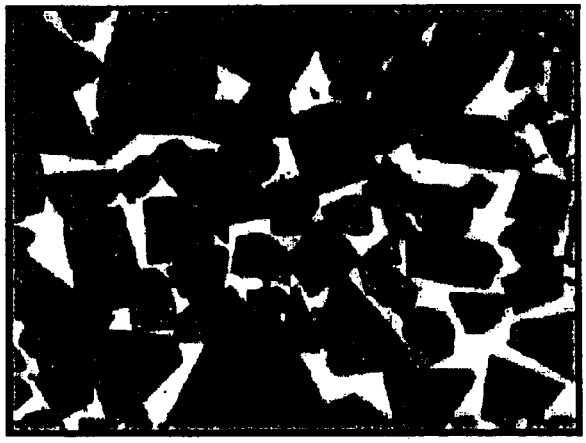
FIG. 4 is a micrograph of another exemplary embodiment coarse grade tungsten carbide substrate according to the present invention.

Exemplary micrographs comparing the surface features of a conventional cutting element substrate grain grade 614, and the inventive cutting element substrates having grain grades of 812 and 916 are shown in FIGS. 2, 3 and 4, respectively. It should be noted that the grain grades identified throughout this disclosure are Smith International Corporation's WC/Co grades, unless otherwise noted, where the first digit generally stands for the median particle size in μm and the second two digits generally stand for the percentage of Cobalt (Co) binder. For example a grade 912 denotes a median particle size of about 9 μm and about 12% Co.

Turning now to the physical properties of the substrates incorporated in the inventive cutting elements, the thermal fatigue and shock resistance of a carbide substrate depends on various material properties, such as thermal properties and mechanical properties. It is believed that the following formula describes the dependency of thermal fatigue and shock resistance on various properties of the material:

$$TFSR \propto (1-\nu)\frac{K}{(\alpha)}\cdot\frac{K_{1C}}{(E)} \tag{1}$$

where TFSR is thermal fatigue and shock resistance, ν is Poisson's ratio, K is thermal conductivity, α is coefficient of thermal expansion, $K_{1C}$ is fracture toughness, and E is elastic modulus. It is noted that fracture toughness (K1c) may be replaced by transverse rupture strength in the formula and a similar correlation will result. As discussed above, the coarse grain substrates according to the current invention have a thermal fatigue value of at least 1.4 and a fracture toughness of at least 18 ksi(in)$^{0.5}$.

For cemented tungsten carbide, Poisson's ratio is generally in the range of about 0.20 to 0.26. The actual value varies with different carbide compositions. On the other hand, the ratio of:

$$\frac{K}{\alpha}$$

represents a composite thermal index which is useful in describing the thermal fatigue and shock resistance for the substrate. Furthermore, the ratio of $$\frac{K_{1C}}{E}$$

represents a composite mechanical index which is also useful in describing the thermal fatigue and shock resistance of a substrate material. Therefore, it is desirable to optimize the product of the composite thermal index and the composite mechanical index to obtain optimal thermal fatigue and shock resistance for the substrate.

It also should be noted that existing carbide grades are formulated to achieve desired toughness and wear resistance. For a WC/Co system, it typically is observed that the wear resistance increases as the grain size of the tungsten carbide particles or the cobalt content decreases. On the other hand, the fracture toughness increases with larger grain size tungsten carbide and greater content of cobalt. Thus, fracture toughness and wear resistance (i.e., hardness) tend to be inversely related, i.e., as the grain size or the cobalt content is decreased to improve the wear resistance of a specimen, the fracture toughness of the specimen decreases and vice versa.

Due to this inverse relationship between fracture toughness and wear resistance (i.e., hardness), the grain size of the tungsten carbide particles and the cobalt content have been often adjusted to obtain the desired wear resistance and toughness. For example, a higher cobalt content and larger WC grains are used when a higher toughness is required, whereas a lower cobalt content and smaller WC grains are used when a better wear resistance is desired.

It should be noted that a higher composite mechanical index is obtained by using larger WC grains and a higher cobalt content. However, an increase in the composite mechanical index may result in a decrease in wear resistance. Therefore, a balance between toughness and composite mechanical index is desired. Because of concerns about impurity levels in coarse substrates, existing cemented tungsten carbide substrates maintain this balance by using relatively smaller WC grain size and relatively high cobalt content. But, due to small WC grain size and high cobalt content, such substrates generally have a low composite thermal index. Consequently, the thermal fatigue and shock resistance of such substrates is relatively poor.

Meanwhile, efforts to improve the thermal composite index generally lead to different formulations of cemented tungsten carbide, such as large tungsten carbide grains with a low cobalt content, however, such materials have been plagued with high levels of impurities. Generally, the thermal conductivity of cemented tungsten carbide is inversely proportional to the cobalt content, i.e., as the cobalt content decreases, the thermal conductivity of cemented tungsten carbide increases. On the other hand, the coefficient of thermal expansion generally is directly proportional to the cobalt content. As a result, as the cobalt content decreases, the composite thermal index increases significantly because of the increase in the thermal conductivity and the decrease in the coefficient of thermal expansion. This increase in the composite thermal index is further enhanced by increasing the grain size of tungsten carbide. Generally, the thermal conductivity of cemented tungsten carbide increases as the grain size of tungsten carbide increases. Applicants have discovered that using larger or coarser tungsten carbide grains, e.g., grains having a size greater than 6 μm and having low levels of impurity e.g., less than 0.1% by weight effect an increase in the composite thermal index and the composite mechanical index of cemented tungsten carbide, which, in turn, enhances the thermal fatigue and shock resistance of the cemented tungsten carbide.

Figure 5:
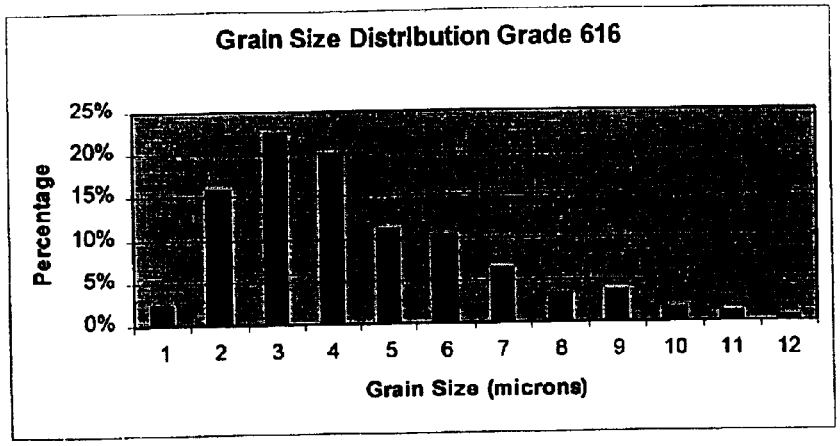
FIG. 5 is a graphical representation of the distribution of particle grain sizes in a conventional substrate material.
Figure 6:
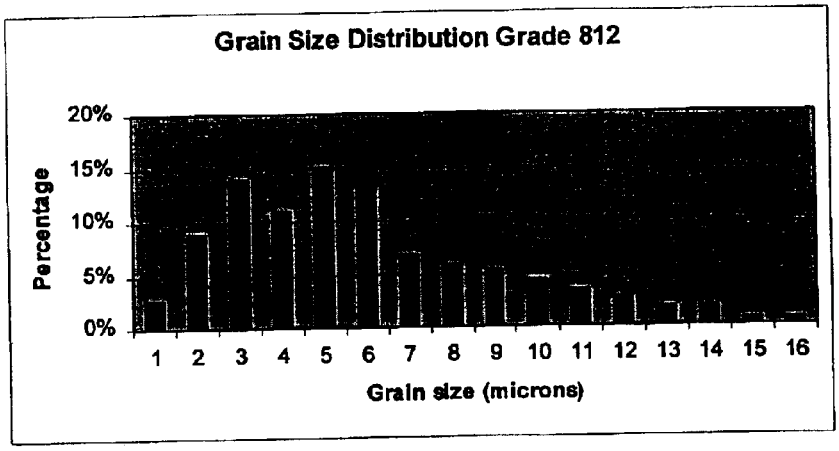
FIG. 6 is a graphical representation of the distribution of particle grain sizes in an exemplary embodiment substrate of the current invention.
Figure 7:
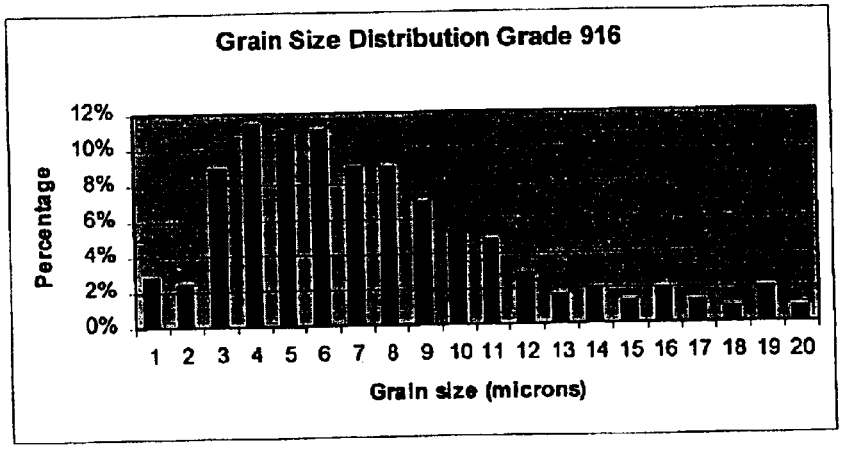
FIG. 7 is a graphical representation of the distribution of particle grain sizes in another exemplary embodiment substrate of the current invention.

A conventional grain grade has a number below 616. It should be noted that grade 616 has a median particle size of 4 μm, although the first digit of the grade is a "6", and a Co content of 6%. Exemplary embodiment substrates having grain grades 812 and 916 have a median grain particle size of at least 6 μm and have at least a 6% concentration of WC particles having a particle size of at least 7 μm and a Co content of between 12 and 16%. The grain size distribution for grade 616, 812 and 916 are shown in FIGS. 5, 6 and 7, respectively. A more complete statistical distribution for the particle size distribution of 616, 812 and 916 grain grade substrates is provided in Table 1, below.

TABLE 1

Particle Size Distribution

| Grade | Average | Standard Deviation | D10 | D50 (Median) | D90 |
|---|---|---|---|---|---|
| 616 | 4.5 | ±2.4 | 2.1 | 4.0 | 7.7 |
| 812 | 7.2 | ±3.6 | 3.4 | 6.4 | 12.0 |
| 916 | 8.8 | ±4.9 | 4.1 | 7.6 | 15.6 |

D10, D50 and D90 refer to the percentage of particles (i.e., 10%, 50% and 90%, respectively) having a size less than or equal to the listed value. For example for grade 812, 50% of the entire grain population has a size of 6.4 μm or less. Thus, D50 also refers to the median grain size of the substrate.

In one exemplary embodiment of the current invention, the median particle size of the substrate is chosen to match or be relatively close to the particle size of the ultra hard material. An example of such matching for both shear cutter and blanks used to form cutting tools is provided in Table 2, below.

TABLE 2

Substrate vs. Ultra hard Layer Coarseness

| Cutting Tool | Diamond Grain Size | WC Median Grain Size | Cobalt % |
|---|---|---|---|
| Shear Cutters | 15 μm | 8 μm | 16 |
| | 25 μm | 15–25 μm | 16 |
| | 45 μm | 25–45 μm | 16 |
| Blanks | 2–4 μm | 2–4 μm | 16 |
| | 4–8 μm | 4–8 μm | 16 |
| | 12–15 μm | 12–15 μm | 16 |
| | 25 μm | 15–25 μm | 16 |

Although the previous discussion describes the substrates of the current invention in relation to particle size, it should be understood that these ranges are exemplary embodiment ranges and other ranges are acceptable so long as the physical properties of the material, such as, wear number, thermal conductivity, hardness and the toughness of the material meet the predetermined values, as described herein. Suitable substrates for constructing the cutting elements according to the current invention may be defined as including those materials having at least one of the following properties: a fracture toughness of at least about 18 ksi(in)$^{0.5}$ and more preferably of at least about 20 ksi(in)$^{0.5}$, a wear number of at least about 1.5 krev/cc, and more preferably of at least about 2 krev/cc, a Palmqvist toughness of at least greater than about 600 kg/mm, a Rockwell A hardness of between about 83 to less than 86, and more preferably between 83 to 85, and a normalized thermal fatigue resistance of at least greater than 1.4, and more preferably greater than about 1.5.

Another exemplary embodiment cutting element of the present invention has a tungsten carbide substrate having tungsten carbide particles and a cobalt binder disposed around the particles. The grain size of the tungsten carbide particles and a content of the cobalt binder are selected to provide the substrate with a fracture toughness of at least about 18 ksi (in)$^{0.5}$ and a wear number of at least about 2. A polycrystalline ultra hard material layer is disposed over the substrate. In another the substrate has a hardness in a range of about 85 to 87 Ra.

A yet further exemplary embodiment cutting element has a tungsten carbide substrate having tungsten carbide particles and a cobalt binder disposed around the particles. The grain size of the tungsten carbide particles and a content of the cobalt binder are selected to provide the substrate with a fracture toughness of at least about 20 ksi $(in)^{0.5}$ and a wear number of at least about 1.5. An ultra hard material layer is disposed over the substrate. In another exemplary embodiment, the substrate has a hardness in a range of about 83 to 85 Ra.

As discussed above, the product of the composite thermal index and the composite mechanical index is representative of the thermal fatigue and shock resistance of a cemented tungsten carbide. An optimal thermal fatigue and shock resistance may be obtained by maximizing the product of the composite thermal index and the composite mechanical index. Applicants have discovered that one method of optimizing the thermal fatigue and shock resistance is to study the dependency of fracture toughness, elastic modulus, thermal conductivity, and coefficient of thermal expansion on various factors, such as grain size, cobalt content, and WC purity. Such studies reveal desirable ranges for compositional characteristics, such as, WC grain size (median particle size of at least 6 μm), cobalt content (at least 12% by weight), and WC impurity (less than 0.1% by weight); and physical characteristics, such as, hardness (between about 83 to 87 Ra), fracture toughness (at least about 18 ksi$(in)^{0.5}$), wear number (at least about 1.5 krev/cc), Palmqvist toughness (at least about 600 kg/mm), and normalized thermal fatigue resistance (at least about 1.4). A number of these studies are discussed below in relation to the substrates of the current invention.

It should be noted that the above formulations are not likely to result in a decrease in the composite mechanical index. Although toughness generally is decreased as a result of using a lower cobalt content, this decrease in toughness is offset by an increase in toughness due to use of large WC grains.

Applicants have discovered that carbide formulations in the exemplary embodiment cutting elements effect an increase in the composite thermal index without decreasing the composite mechanical index of the cutting element substrates. Consequently, the thermal fatigue and shock resistance of the carbide substrate formulations for the shear cutters according to the current invention are improved.

The substrates incorporated in the exemplary embodiment cutting elements may also be described in terms of their coefficient of thermal expansion. For existing grades of cemented tungsten carbide, the coefficient of thermal expansion is generally in the range of $4\times10^{-6}$ to $7\times10^{-6}/°$ C. Furthermore, the thermal conductivity of existing grades of cemented tungsten carbide generally falls below a value as defined by the following equation:

$$K_{min}=0.00102X^2-0.03076X+0.5464 \quad (2)$$

where $K_{min}$ is the minimal thermal conductivity in the unit of cal/cm·s·K, and X is cobalt content by weight %. Exemplary embodiment substrate of the present invention utilize cemented tungsten carbide with a thermal conductivity in excess of approximately $K_{min}$ as determined by Equation 2.

Figure 8:
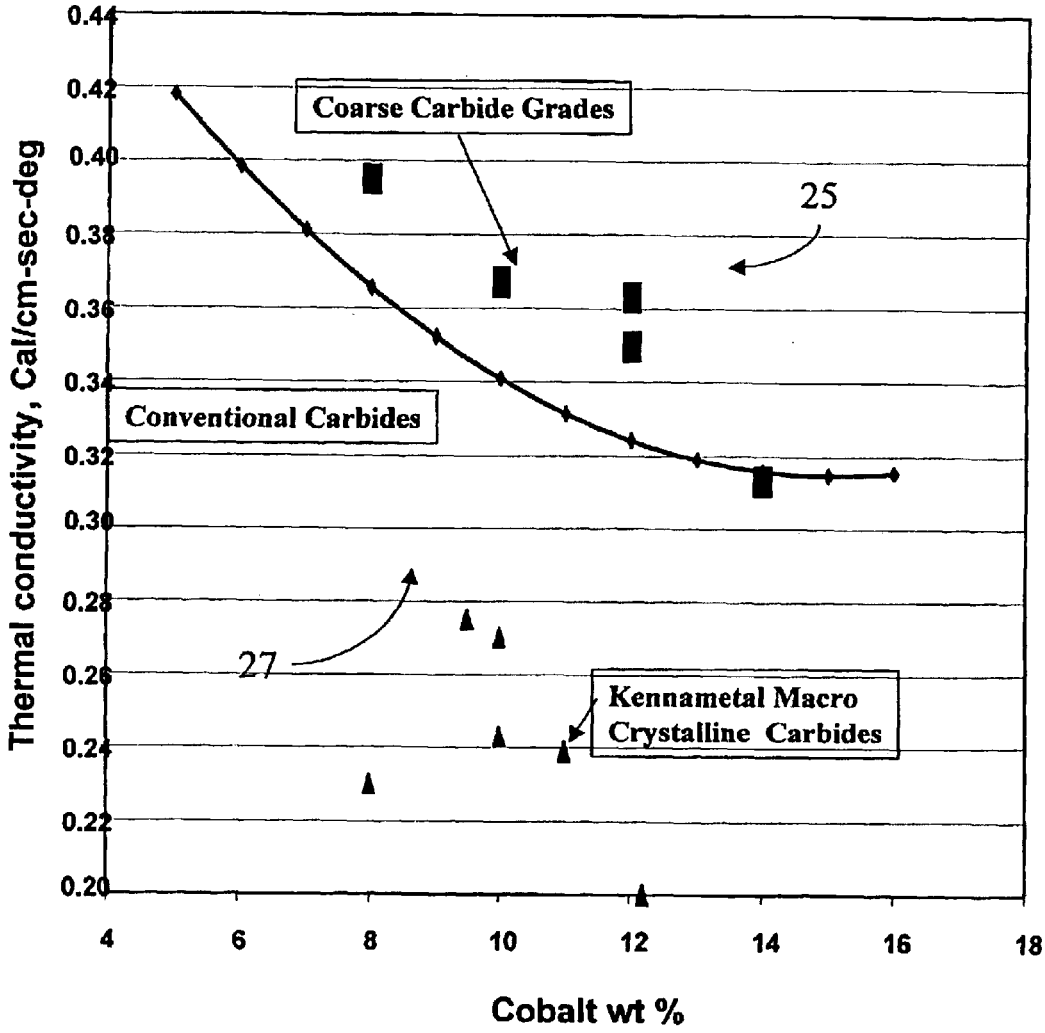
FIG. 8 is a graphical representation of the thermal conductivity of conventional substrates and exemplary embodiments of the coarse grain carbide substrate grades of the current invention.

It should be noted that Equation 2 is derived from existing thermal conductivity data for various grades used in the art. FIG. 8 is a graph showing thermal conductivity as a function of cobalt content. The solid squares represent thermal conductivity of relatively coarse grain tungsten carbide grades. A quadratic curve 23 divides the graph into two regions: 25 and 27.

It should also be noted that region 25 alternatively may be defined above a straight line 29. The line may be expressed by the following equation:

$$K_{min}=0.38-0.00426X \quad (3)$$

While thermal conductivity is specified with reference to its value at the ambient condition, i.e., room temperature and pressure, it should be understood that thermal conductivity depends on various factors, including temperature and pressure. Therefore, the thermal conductivity of cemented tungsten carbide cutting elements under operating conditions may differ from the values disclosed herein if they are subjected to a higher temperature and/or pressure. For illustrative purposes, exemplary embodiments of the invention are described with reference to the thermal conductivity values at room temperature and pressure. The improved thermal fatigue and shock resistance obtained in exemplary embodiments of the invention may be described by the composite thermal index, which is defined above as the quotient of the thermal conductivity over the coefficient of thermal expansion.

As discussed above, another factor which influences the thermal conductivity of cemented tungsten carbide is the purity of the carbide. Generally as the carbide purity increases, the thermal conductivity of the carbide will increase. In a stoichiometric WC crystal, the carbon content is at 6.13% by weight of WC. Either excess tungsten (also referred to as "eta phase") or excess carbon (also referred to as "free carbon") may be present in the carbide. Furthermore, iron, titanium, tantalum, niobium, molybdenum, silicon oxide, and other materials also may be present. These materials are collectively referred to as "impurities." These impurities may adversely affect the thermal conductivity of the cemented tungsten carbide.

In some embodiments, conventionally carburized tungsten carbide is used. Conventionally carburized tungsten carbide is a product of the solid state diffusion of tungsten metal and carbon at a high temperature in a protective atmosphere. It is preferred to use conventionally carburized tungsten carbide with an impurity level of less than 0.1% by weight.

In other exemplary embodiments, tungsten carbide grains designated as WC MAS 2000 and 3000–5000 (available from H. C. Starck of Germany) are used. It is noted that similar products may be obtained from other manufacturers. These tungsten carbide grains contain a minimum of 99.8% WC and the total carbon content is at 6.13±0.05% with free carbon in the range of 0.04±0.02%. The total impurity level, including oxygen impurities, is less than about 0.16%.

MAS 2000 and 3000–5000 grades have larger particles. Tungsten carbide in these grades is in the form of polycrystalline aggregates. The size of the aggregates is in the range of about 20–50 μm. After milling or powder processing, most of these aggregates break down to single-crystal tungsten carbide particles having a median particle size in the range of about 7–9 μm. These large single-crystal tungsten carbide grains are suitable for use in embodiments of the invention.

It is recognized that thermal fatigue and shock resistance are not the only factors that determines the lifetime of a cutting element. Wear resistance, i.e., hardness, is another factor. In some embodiments, after the ranges of acceptable WC grain sizes, cobalt content, and carbide purity have been determined, the desirable wear resistance is selected. In one embodiment of the current invention, a suitable substrate has a wear number of at least 1.5 krev/cc.

Alternatively, because Rockwell A hardness correlates well with wear resistance, desirable wear resistance may be determined on the basis of Rockwell A hardness data. Accordingly, in another exemplary embodiment cutting element of the current invention a suitable substrate has a Rockwell A hardness of between about 83 and 85. It is known that the hardness of cemented tungsten carbide depends on the cobalt content and the tungsten carbide grain size. A preferred hardness for exemplary embodiment cutting element substrates of the invention exceeds a value designated as "$H_{min}$" according to the following equation:

$$H_{min}=91.1-0.63X \quad (4)$$

where $H_{min}$ is minimal Rockwell A scale hardness, and X is cobalt content by weight.

The following examples provide comparisons between conventional substrates and exemplary embodiments of substrates used in shear cutters according to the present invention and are not restrictive of the invention as otherwise described herein. It should be noted that Equations 1–4 as well as some of the following examples were disclosed in U.S. Pat. No. 6,197,084 in relation to inserts for use in roller cone bits. The contents of U.S. Pat. No. 6,197,084 are fully incorporated herein by reference.

EXAMPLE 1

This example shows that a coarse grain grade carbide substrate has an improved thermal conductivity, i.e., higher than $K_{min}$. Thermal conductivity may be measured by various methods conventional in the art. In this example, thermal conductivity is obtained by the flash method in accordance with the American Standard Testing Manual ("ASTM") standard E 1461-92 for measuring thermal diffusivity of solids. Thermal conductivity is defined as the time rate of steady heat flow through a unit thickness of an infinite slab of a homogeneous material in a direction perpendicular to the surface, induced by a unit temperature difference. Thermal diffusivity of a solid material is equal to the thermal conductivity divided by the product of the density and specific heat. The specific heat of a WC/Co system can be measured by differential scanning calorimetry based on ASTM-E 1269-94 and is generally in the range of about 0.05 cal/gK for conventional carbide grades used in drag bit applications.

In the flash method, thermal diffusivity is measured directly, and thermal conductivity is obtained by multiplying thermal diffusivity by the density and specific heat capacity. To measure thermal diffusivity, a small, thin disc specimen mounted horizontally or vertically is subjected to a high-density short duration thermal pulse. The energy of the pulse is absorbed on the front surface of the specimen and the resulting rear surface temperature rise is measured. The ambient temperature of the specimen is controlled by a furnace or cryostat. Thermal diffusivity values are calculated from the specimen thickness and the time required for the rear surface temperature rise to reach certain percentages of its maximum value. This method has been described in detail in a number of publications and review articles. See, e.g., F. Righini, et al., "Pulse Method of Thermal Diffusivity Measurements, A Review," High Temperature-High Pressures, vol. 5, pp. 481–501 (1973) the contents of which are fully incorporated herein by reference.

Figure 9:
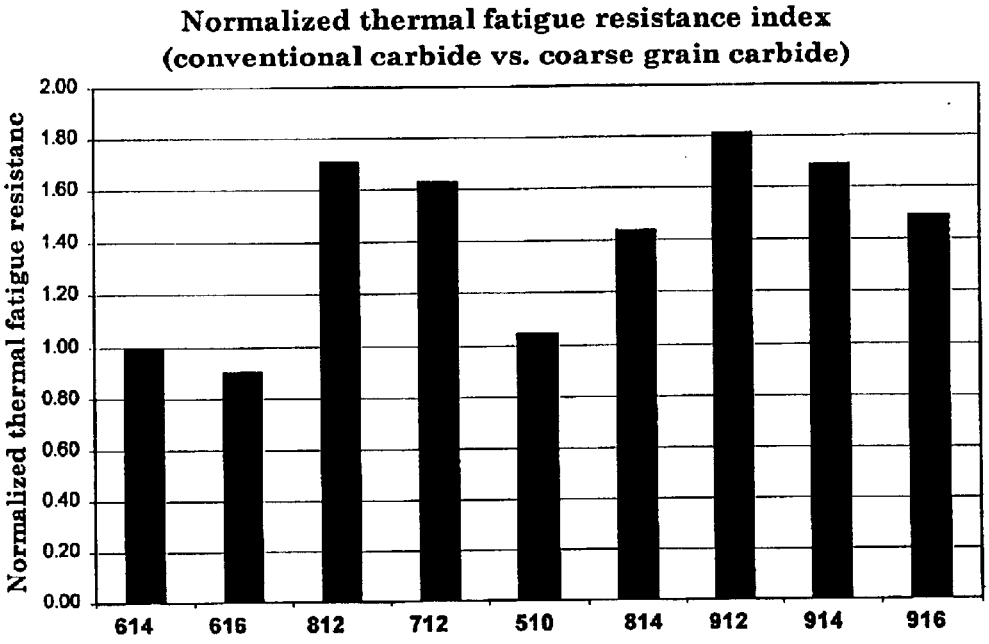
FIG. 9 is a graphical representation of the normalized thermal fatigue resistance of conventional substrates and exemplary embodiments of the coarse grain carbide substrates of the current invention.

FIG. 8 shows a comparison of thermal conductivity data for both conventional substrate materials and for the coarse substrate materials, while FIG. 9 shows a comparison of thermal resistance index data for conventional substrate materials and coarse substrate materials. A series of specimens was prepared according to the standard test procedure. The specimens included the following coarse grades: median 9 μm WC particle size and 12% Co (grade 912); median 9 μm WC particle size and 14% Co (grade 914); and median 9 μm WC particle size and 16% Co (grade 916). Thermal diffusivity of these specimens was measured by the flash method (as described above), and thermal conductivity was calculated accordingly. The thermal conductivity data shows that the coarse grades of cemented tungsten carbide have a thermal conductivity greater than $K_{min}$ as determined by Equation 2. It can be seen that the coarse grain grades have thermal conductivities and thermal resistances similar to those of the large particle size conventional grades and vastly superior to low particles size conventional grades with equivalent cobalt content. Also, most of the coarse grain grades have thermal conductivities higher than $K_{min}$.

EXAMPLE 2

Figure 10:
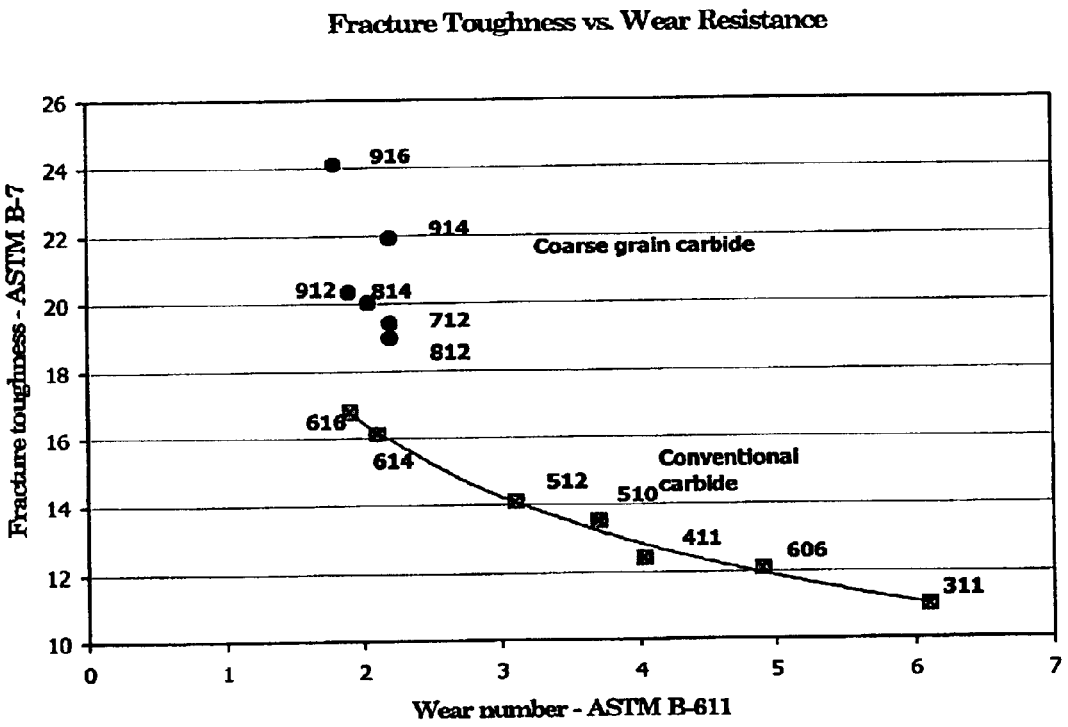
FIG. 10 is a graphical representation of the fracture toughness vs. wear resistance of conventional substrates and exemplary embodiments of the coarse grain carbide substrates of the current invention.

FIG. 10 provides a comparison of wear resistance data for the coarse grain substrates and conventional substrates. In this Figure the fracture toughness of the materials is plotted versus the wear number of the materials.

To evaluate the toughness of a carbide, the ASTM B771 test, which measures the fracture toughness (K1c) of cemented tungsten carbide material, was used. It has been found that the ASTM B771 test, correlates well with the insert breakage resistance in the field.

This test method involves application of an opening load to the mouth of a chevron-shaped slot formed in a short rod or short bar specimen. Load versus displacement across the slot at the specimen mouth is recorded autographically. As the load is increased, a crack initiates at the point of the chevron-shaped slot and slowly advances longitudinally, tending to split the specimen in half. The load goes through a smooth maximum when the width of the crack front is about one-third of the specimen diameter (short rod) or breadth (short bar). Thereafter, the load decreases with further crack growth. Two unloading-reloading cycles are performed during the test to measure the effects of any residual microscopic stresses in the specimen. The fracture toughness is calculated from the maximum load in the test and a residual stress parameter which is evaluated from the unloading-reloading cycles on the test record.

Meanwhile, wear resistance was determined by the ASTM B-611 standard test method. It has been found that the ASTM B611 correlates well with field performance in terms of relative insert wear life time.

The ASTM B-611 test was conducted in an abrasion wear test machine, which has a vessel suitable for holding an abrasive slurry and a wheel made of annealed steel which rotates in the center of the vessel at about 100 RPM. Four curved vanes are affixed to either side of the wheel to agitate and mix the slurry and to propel it toward a specimen. The testing procedure is described below.

A test specimen with at least a 3/16 inch thickness and a surface area large enough so that the wear would be confined within its edges was prepared. The specimen was weighed on a balance and its density determined. Then, the specimen was secured within a specimen holder which is inserted into the abrasion wear test machine and a load is applied to the specimen that is bearing against the wheel. An aluminum oxide grit of 30 mesh was poured into the vessel and water was added to the aluminum oxide grit. Just as the water began to seep into the abrasive grit, the rotation of the wheel was started and continued for 1,000 revolutions. The rotation of the wheel was stopped after 1,000 revolutions and the sample was removed from the sample holder, rinsed free of grit, and dried. Next, the specimen was weighed again, and the wear number (W) was calculated according to the following formula: W=D/L, where D is specimen density in gms/cc and L is weight loss in gms.

In the current example, two groups of specimens were tested for both fracture toughness and wear resistance. One group consisted of specimens of the coarse grades according to the current invention (814, 912, 914, and 916), while the other group consisted of specimens of the conventional grades (311, 411, 510, 512, 606, 614, and 616). FIG. 10 shows the wear number plotted against toughness for each specimen. As both wear number and fracture toughness relate to hardness, plotting these values against one another is useful in showing overall performance characteristics of the specimens. As in the other plots, squares are used to represent the conventional substrates and circles are used to represent the coarse substrates according to the current invention.

From the plot it can be seen that the wear numbers of the coarse substrates are similar to those of the coarsest of the standard grades. Accordingly, it is important to recognize that contrary to standard teachings, the wear resistance of the coarse substrate materials according to the current invention do not exhibit decreased wear resistance that is proportional with the increase in fracture toughness. Accordingly, the coarse substrates according to the current invention have higher overall performance characteristics.

EXAMPLE 3

Figure 11:
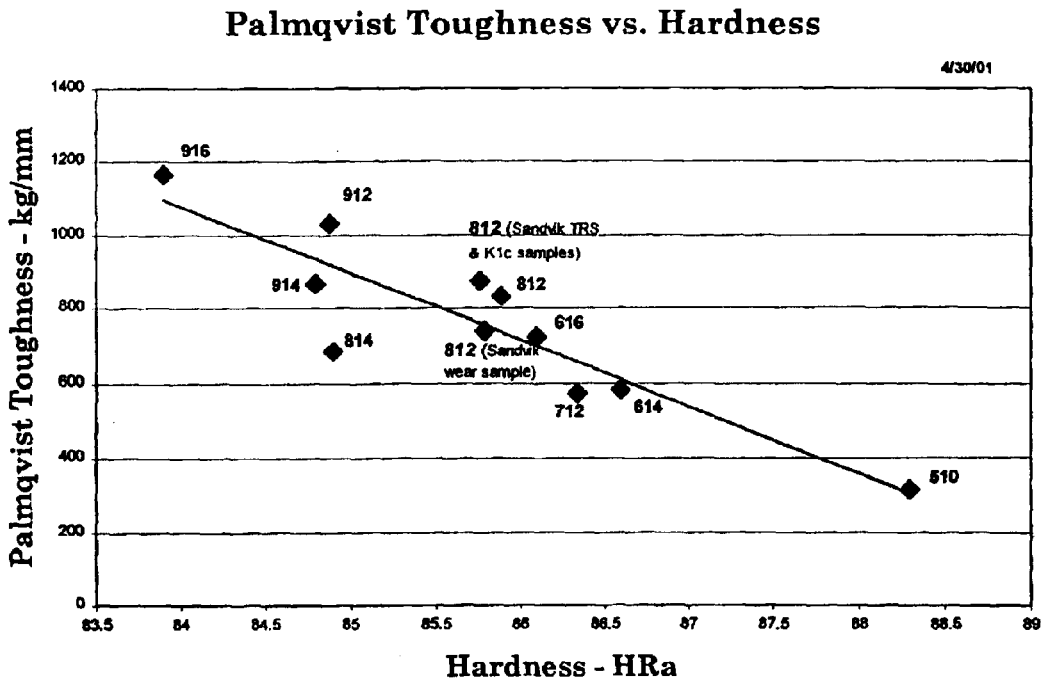
FIG. 11 is a graphical representation of the Palmqvist toughness vs. hardness of conventional substrates and exemplary embodiments of the coarse grain carbide substrates of the current invention.

Palmquist toughness, in kg/mm, and hardness, in Ra, were measured and plotted in FIG. 11 for both coarse substrates and conventional carbide substrates. Two groups of specimens were prepared. One group consisted of specimens of the following conventional grades: 510, 512, and 614. The other group consisted of specimens of the following coarse grades: 712, 812, 814, 912, 914, and 916. As shown in FIG. 11, the coarse substrates showed improved Palmqvist toughness when compared to the standard substrate materials.

EXAMPLE 4

Figure 12:
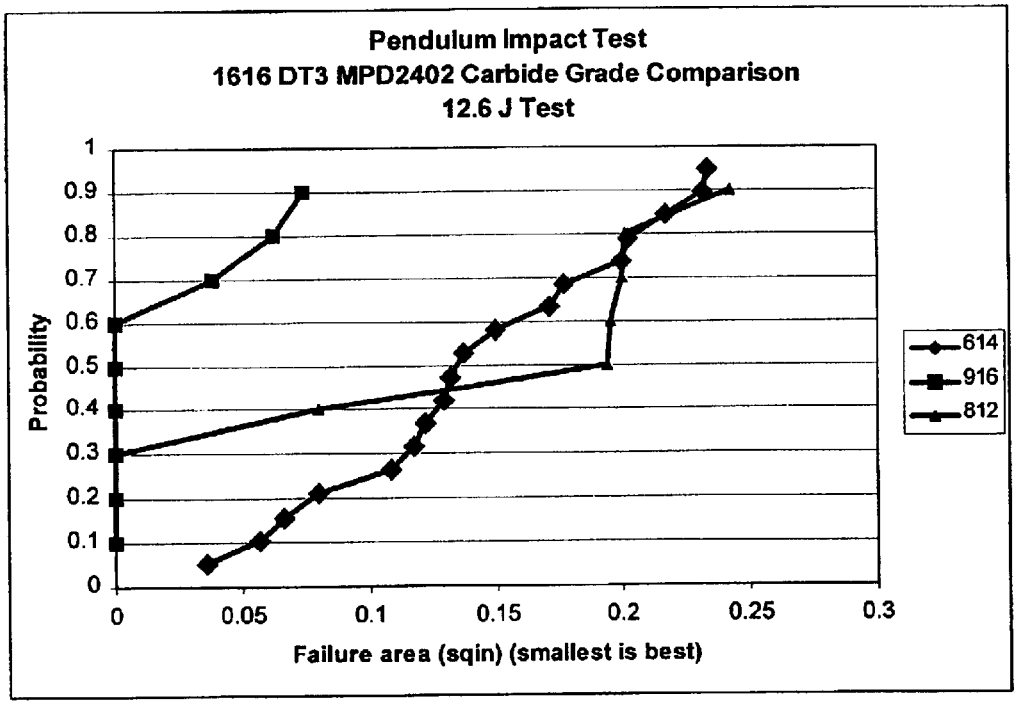
FIG. 12 is a graphical representation of pendulum impact test results for conventional substrates and exemplary embodiments of the coarse grain carbide substrates of the current invention.
Figure 13:
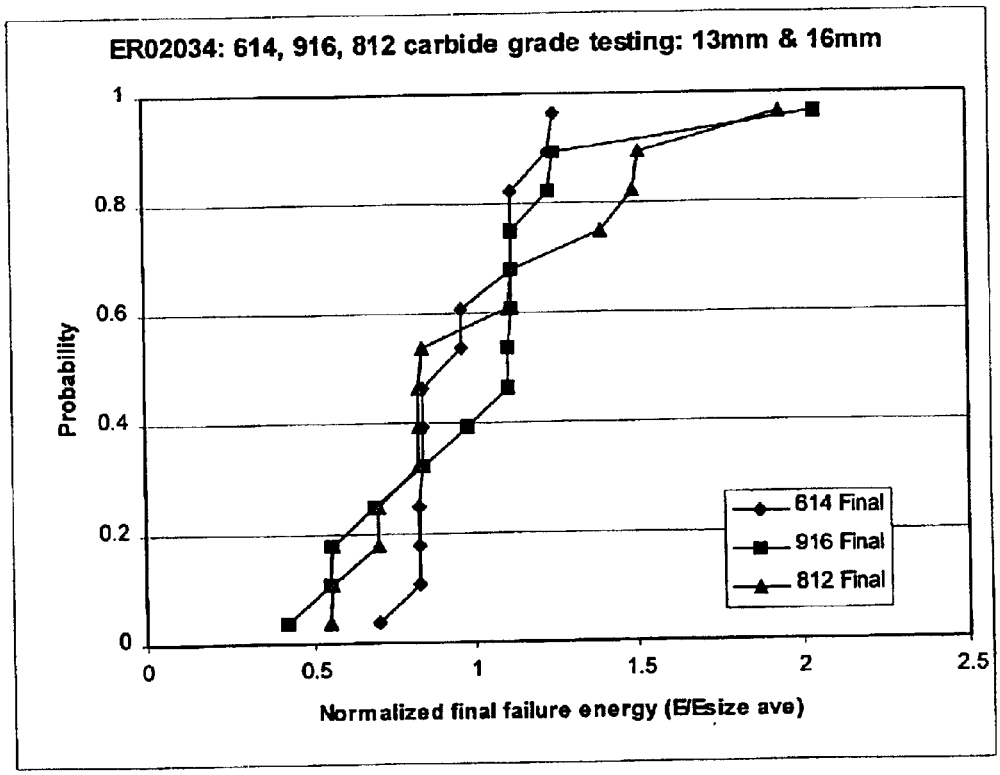
FIG. 13 is a graphical representation of drop tower impact test results for conventional substrates and exemplary embodiments of the coarse grain carbide substrates of the current invention.

This example provides pendulum and drop tower impact test results for conventional substrates and coarse grain substrates. FIGS. 12 (pendulum test) and 13 (drop test) plot failure probability under pendulum and drop stresses versus failure area and failure energy, respectively. As shown, the coarse grain 916 substrates show superior survivability properties over the conventional 614 substrates.

As the above examples and description both illustrate, inventive cutting elements having coarse grain substrates have many improved properties, including improved thermal fatigue, shock resistance, toughness, and wear resistance. The cutting elements of the present invention using tungsten carbide coarse substrates experience reduced thermal fatigue and thermal shock, thereby increasing the lifetime of such cutting elements.

While the invention has been disclosed with respect to a limited number of exemplary embodiments, those skilled in the art will appreciate numerous modifications and variations therefrom. For example, wear-resistant materials suitable for use in substrates in exemplary embodiment cutting elements of the invention may be selected from compounds of carbide and metals selected from Groups IVB, VB, VIB, and VIIB of the Periodic Table of the Elements. Examples of such carbides include tantalum carbide and chromium carbide. Binder matrix materials suitable for use in embodiments of the invention include the transition metals of Groups VI, VII, and VIII of the Periodic Table of the Elements. For example, iron and nickel are good binder matrix materials. It is intended that the appended claims cover all such modifications and variations as fall within the true spirit and scope of the invention. In an embodiment including a binder, the substrate may have at least 12% binder material by weight. In a further exemplary embodiment, the surface of the substrate provides an irregular interface with the cutting layer.

With all of the above described exemplary embodiments, a coating may be applied over the ultra hard material layer to improve the thermal stability and to change the residual stresses in the ultra hard material layer, and to protect the cobalt in the ultra hard material layer from the corrosive environment during drilling. In one embodiment, a tungsten coating in foil form is placed over the ultra hard material sheet layer prior to sintering. Once the cutting element is sintered, the tungsten foil forms into a tungsten carbide coating.

To form a cutting element of the present invention such as a shear cutter, the substrate and ultra hard material are sintered in a high pressure, high temperature (HPHT) press, forming a cutting element with a cemented tungsten-carbide substrate and a polycrystalline ultra hard material cutting layer. The sintering process causes the substrate material and the cutting material to sinter and bond completely to each other. In essence, the substrate becomes integral with the cutting layer creating a single cutting element piece. In an exemplary embodiment, a cutting element such as a shear cutter may be formed by placing a cemented carbide substrate into the container of a press. A mixture of diamond grains or diamond grains and catalyst binder is placed atop the substrate and compressed under high pressure, high temperature conditions. In so doing, metal binder migrates from the substrate and passes through the diamond grains to promote a sintering of the diamond grains. As a result, the diamond grains become bonded to each other to form the diamond layer, and the diamond layer is subsequently bonded to the substrate. The substrate is often a metal-carbide composite material, such as tungsten carbide. Therefore, it is within the scope of the present invention that compositions such as those described herein may be used to form metal-carbide composite substrates.

In another exemplary embodiment, a method is provided for manufacturing a cutting element by providing a substrate having an endsurface. The substrate is formed from a composition including tungsten carbide having a median particle size of at least 6 μm and/or an impurity content of not greater than 0.1% by weight, and a binder material. The substrate is formed by heating the composition causes the binder to infiltrate and cement the tungsten carbide. An ultra hard material layer is placed over the substrate end surface and the resulting assembly of substrate and ultra hard material layer is processed at a sufficient temperature and pressure for forming polycrystalline ultra hard material and metallurgicaly joining of the substrate and polycrystalline ultra hard material. In a further exemplary embodiment method, the tungsten carbide is provided in powder form and is cemented with a binder during the act of heating for forming the polycrystalline ultra hard material. In an alternate exemplary embodiment, the tungsten carbide powder and binder may be heated to at least partly cement the tungsten carbide powder prior to heating for forming the polycrystalline ultra hard material. Other conventional methods may be used for forming the cutting elements of the present invention.

Figure 14:
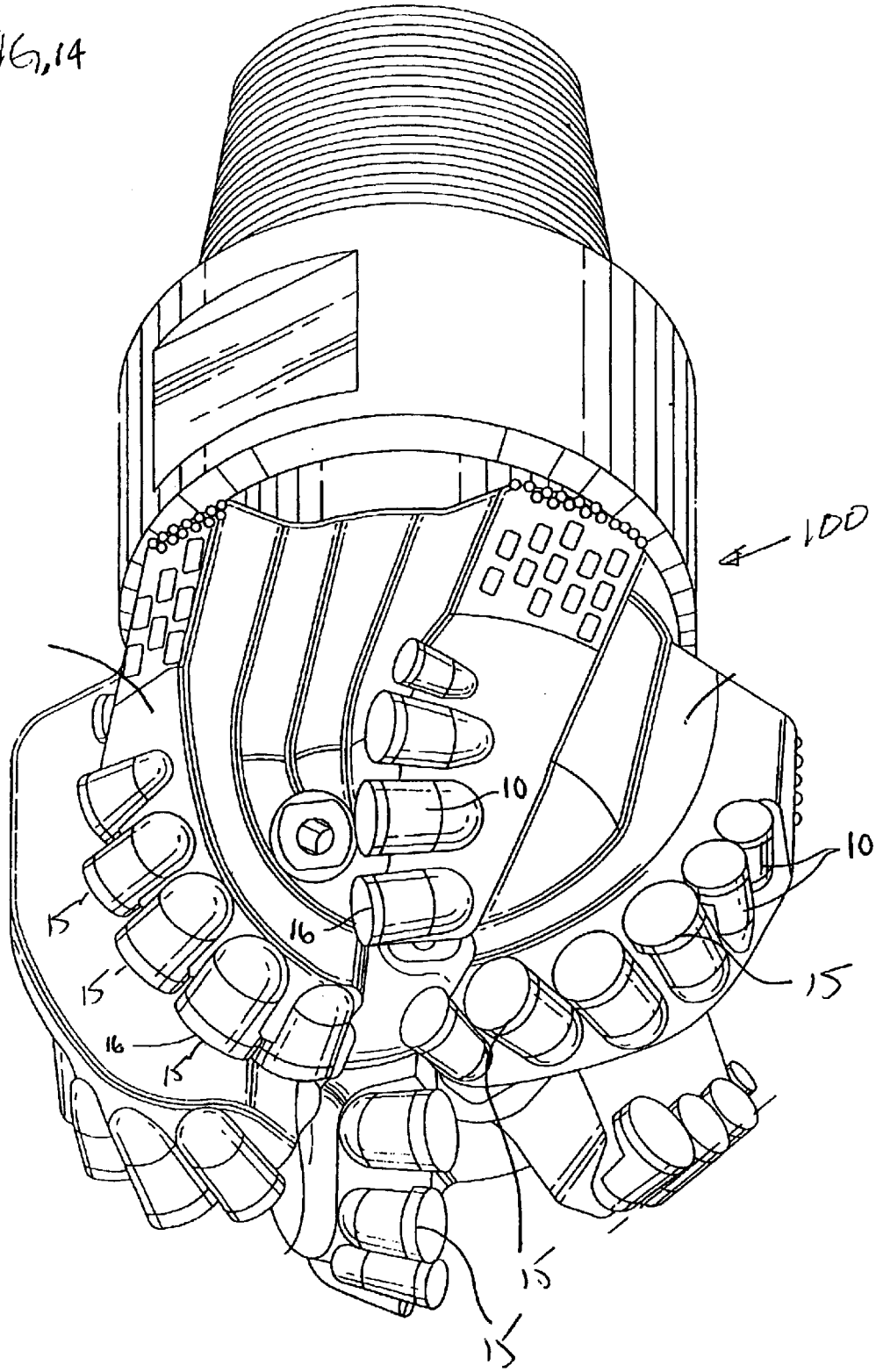
FIG. 14 is a perspective view of an exemplary embodiment drag bit incorporating exemplary embodiment cutting elements of the present invention.
Figure 9:
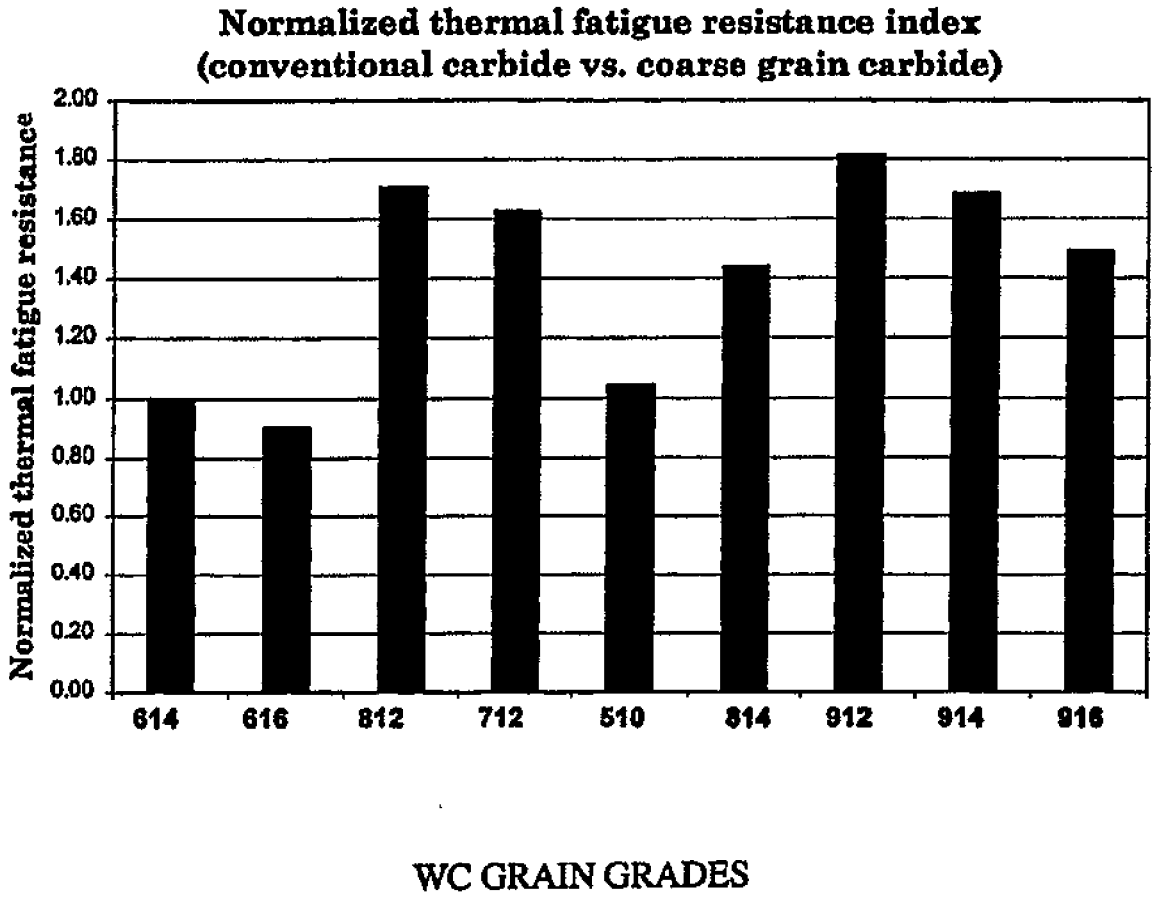

In other exemplary embodiments of the present invention, drag bits are provided having any of the exemplary embodiment shear cutters mounted on their body 100 as for example shown in FIG. 14. The shear cutters are typically brazed in pockets in the drag bit body at a rake angle for contacting the earth formations with their edges 15.

Various ASTM specifications are referenced to herein. It should be noted that the contents of these specifications are fully incorporated herein by reference.

Although specific embodiments are disclosed herein, it is expected that persons skilled in the art can and will design alternative coarse grain cutting elements and methods to produce the coarse grain cutting elements that are within the scope of the following claims either literally or under the Doctrine of Equivalents.

What is claimed is:

1. A shear cutter comprising:

a substrate having an end surface, wherein the substrate is formed by the consolidation of a composition comprising tungsten carbide and a binder material, the substrate after consolidation not having a double cemented microstructure and having at least one substrate property selected from the group consisting of a median particle size of at least 6 μm, a Rockwell A hardness less than 86, and an impurity content of the tungsten carbide being not greater than about 0.1% by weight; and an ultra hard material layer over the end surface of the substrate, wherein the ultra hard material comprises ultra hard material particles, wherein the median particle size of the ultra hard particles is approximately the same as the median particle size of the substrate.

2. The shear cutter as recited in claim 1 further comprising at least one intermediate layer between the substrate and the ultra hard material layer.

3. The shear cutter as recited in claim 1 wherein the substrate has a median particle size of at least about 9 μm.

4. The shear cutter as recited in claim 1 wherein the substrate has a fracture toughness after consolidation of at least about 18 ksi(in)$^{0.5}$.

5. The shear cutter as recited in claim 1 wherein the substrate has a hardness after consolidation in the range from about 83 to about 85 Rockwell A.

6. The shear cutter as recited in claim 1 wherein the substrate end surface is non-planar.

7. The shear cutter as recited in claim 1 wherein the ultra hard material layer comprises an ultra hard material selected from the group consisting of diamond, cubic boron nitride and a mixture thereof.

8. The shear cutter as recited in claim 1 wherein after consolidation the substrate has a fracture toughness of at least about 18ksi(in)$^{0.5}$ and a hardness in the range from about 83 to about 85 Rockwell A.

9. A shear cutter comprising:

a substrate having an end surface, wherein the substrate is formed by the consolidation of a composition comprising tungsten carbide and a binder material, the substrate after consolidation not having a double cemented microstructure and having at least one substrate property selected from the group consisting of a median particle size of at least 6 μm, a Rockwell A hardness less than 86, and an impurity content of the tungsten carbide being not greater than about 0.1% by weight; and an ultra hard material layer over the end surface of the substrate, wherein the substrate comprises at least a 6% concentration of particles having a grain size of at least 7 μm or more.

10. The shear cutter as recited in claim 9 further comprising at least one intermediate layer between the substrate and the ultra hard material layer.

11. The shear cutter as recited in claim 9 wherein the substrate has a median particle size of at least about 9 μm.

12. The shear cutter as recited in claim 9 wherein the substrate has a fracture toughness after consolidation of at least about 18 ksi(in)$^{0.5}$.

13. The shear cutter as recited in claim 9 wherein the substrate has a hardness after consolidation in the range from about 83 to about 85 Rockwell A.

14. The shear cutter as recited in claim 9 wherein the substrate end surface is non-planar.

15. The shear cutter as recited in claim 9 wherein the ultra hard material layer comprises an ultra hard material selected from the group consisting of diamond, cubic boron nitride and a mixture thereof.

16. The shear cutter as recited in claim 9 wherein after consolidation the substrate has a fracture toughness of at least about 18 ksi(in)$^{0.5}$ and a hardness in the range from about 83 to about 85 Rockwell A.

17. A cutting element comprising:

a substrate having an end surface, wherein the substrate is formed by the consolidation of a composition comprising tungsten carbide and a binder material, the substrate after consolidation having at least one substrate property selected from the group consisting of a median particle size of at least 6 μm, a Rockwell A hardness less than 86, and an impurity content of the tungsten carbide being not greater than about 0.1% by weight; and an ultra hard material layer over the end surface of the substrate, wherein the ultra hard material comprises ultra hard material particles, and wherein the median particle size of the ultra hard particles is approximately the same as the median particle size of the substrate.

18. A cutting element comprising:

a substrate having an end surface, wherein the substrate is formed by the consolidation of a composition comprising tungsten carbide and a binder material, the substrate after consolidation having at least one substrate property selected from the group consisting of a median particle size of at least 6 μm, a Rockwell A hardness less than 86, and an impurity content of the tungsten carbide being not greater than about 0.1% by weight, wherein the substrate comprises at least a 6% concentration of particles having a grain size of at least 7 μm or more; and an ultra hard material layer over the end surface of the substrate.

19. The cutting element as recited in claim 18 further comprising at least one intermediate layer between the substrate and the ultra hard material layer.

20. The cutting element as recited in claim 18 wherein the substrate has a median particle size of at least about 9 μm.

21. The cutting element as recited in claim 18 wherein the substrate has a fracture toughness after consolidation of at least about 18 ksi(in)$^{0.5}$.

22. The cutting element as recited in claim 18 wherein the substrate has a hardness after consolidation in the range from about 83 to about 85 Rockwell A.

23. The cutting element as recited in claim 18 wherein the substrate end surface is non-planar.

24. The cutting element as recited in claim 18 further wherein the ultra hard material layer comprises an ultra hard material selected from the group consisting of diamond, cubic boron nitride and a mixture thereof.

25. The cutting element as recited in claim 18 wherein after consolidation the substrate has a fracture toughness of at least about 18 ksi(in)$^{0.5}$ and a hardness in the range from about 83 to about 85 Rockwell A.

26. The cutting element as recited in claim 18 wherein the ultra hard material comprises ultra hard material particles, wherein the median particle size of the ultra hard particles is approximately the same as the median particle size of the substrate.

27. The cutting element as recited in claim 18 wherein the substrate comprises at least a 6% concentration of particles having a grain size of at least 7 μm or more.

28. The cutting element as recited in claim 18 wherein the substrate comprises cobalt and wherein the impurity content of the tungsten carbide is controlled to provide a thermal conductivity after consolidation not less than a value $K_{min}$ as determined by the following equation:

$K_{min}=0.38-0.00426X$, where $X$ in the substrate cobalt content in weight %.

29. The cutting element as recited in claim 18 wherein the substrate comprises cobalt and wherein the substrate composition has a minimal Rockwell A scale hardness $H_{min}$ after consolidation defined by the equation:

$H_{min}=91.1-0.63X$, where $X$ is the substrate cobalt content in weight %.

30. The cutting element as recited in claim 18 wherein the substrate comprises cobalt, wherein the impurity content of the tungsten carbide is controlled to provide a thermal conductivity not less than a value $K_{min}$ as determined by the following equation:

$$K_{min}=0.00102X^2-0.03076X+0.5454,$$

where X is the substrate cobalt content in weight %, and $K_{min}$ is in the units of cal/cm·s·K.

31. The cutting element as recited in claim 18 further comprising a transition layer between the substrate and the ultra hard material layer.

* * * * *

UNITED STATES PATENT AND TRADEMARK OFFICE

CERTIFICATE OF CORRECTION

PATENT NO. : 7,017,677 B2
APPLICATION NO. : 10/437750
DATED : March 28, 2006
INVENTOR(S) : Keshavan et al.

It is certified that error appears in the above-identified patent and that said Letters Patent is hereby corrected as shown below:

| | |
|---|---|
| Column 1, line 64 | Delete “tungstem”,<br>Insert --tungsten-- |
| Column 1, line 65 | Delete “dispensed”,<br>Insert --dispersed-- |
| Column 2, line 60 | After “exemplary”,<br>Insert --embodiment-- |
| Column 3, line 17 | Delete “X in”,<br>Insert --X is-- |
| Column 3, line 59 | Delete “endsurface”,<br>Insert --end surface-- |
| Column 3, line 63 | Delete “composition causes”,<br>Insert --composition, which causes-- |
| Column 3, line 69 | Delete “metallurgicaly”,<br>Insert --metallurgically-- |
| Column 4, line 19 | Delete “X in”,<br>Insert --X is-- |
| Column 12, line 21 | Delete “this Figure”,<br>Insert --this figure-- |
| Column 13, line 31 | Delete “Palmquist”,<br>Insert --Palmqvist-- |
| Column 14, line 46 | Delete “endsurface”,<br>Insert --end surface-- |
| Column 14, line 50 | Delete “composition causes”,<br>Insert --composition, which causes-- |
| Column 14, line 56 | Delete “metallurgicaly”,<br>Insert --metalurigcally-- |

UNITED STATES PATENT AND TRADEMARK OFFICE

CERTIFICATE OF CORRECTION

PATENT NO. : 7,017,677 B2
APPLICATION NO. : 10/437750
DATED : March 28, 2006
INVENTOR(S) : Keshavan et al.

It is certified that error appears in the above-identified patent and that said Letters Patent is hereby corrected as shown below:

| | |
|---|---|
| Column 17, line 19, Claim 28 | Delete "X in",<br>Insert --X is-- |
| Column 18, line 13, Claim 30 | Delete "$K_{min}$=0.00102$X^2$-0.03076X+0.5454,"<br>Insert --$K_{min}$=0.00102$X^2$-0.03076X+0.5464,-- |

In the Drawings

| | |
|---|---|
| FIG. 9, Sheet 5 of 10 | Delete Drawing Sheet 5 and substitute therefore the Drawing Sheet, consisting of Fig. 9, as shown on the attached page |

Signed and Sealed this

Nineteenth Day of December, 2006

JON W. DUDAS
*Director of the United States Patent and Trademark Office*